US007987526B2

(12) United States Patent
Durham

(10) Patent No.: US 7,987,526 B2
(45) Date of Patent: Aug. 2, 2011

(54) PROTECTIVE GEAR FOR THE BODY AND METHODS OF MAKING THE SAME

(75) Inventor: David Durham, San Clemente, CA (US)

(73) Assignee: Fox Head, Inc., Morgan Hill, CA (US)

( * ) Notice: Subject to any disclaimer, the term of this patent is extended or adjusted under 35 U.S.C. 154(b) by 0 days.

(21) Appl. No.: 12/101,117

(22) Filed: Apr. 10, 2008

(65) Prior Publication Data

US 2008/0250552 A1 Oct. 16, 2008

Related U.S. Application Data

(60) Provisional application No. 60/911,804, filed on Apr. 13, 2007.

(51) Int. Cl.
*A41D 13/00* (2006.01)

(52) U.S. Cl. ..... 2/467

(58) Field of Classification Search ..... 2/462–465, 2/455, 456, 467, 247, 102, 44, 45, 2.5, 267, 2/269, 908

See application file for complete search history.

(56) References Cited

U.S. PATENT DOCUMENTS

| | | | | |
|---|---|---|---|---|
| 3,366,970 | A | 2/1968 | Morgan | |
| 3,829,899 | A * | 8/1974 | Davis | 2/2.5 |
| 4,507,801 | A * | 4/1985 | Kavanagh et al. | 2/462 |
| D284,516 | S | 7/1986 | Dyer | |
| D317,368 | S | 6/1991 | Henson | |
| D329,508 | S | 9/1992 | Fair | |
| 5,325,537 | A * | 7/1994 | Marion | 2/462 |
| 5,443,883 | A | 8/1995 | Park | |
| 5,617,582 | A | 4/1997 | Burwell | |
| 5,677,029 | A | 10/1997 | Prevorsek et al. | |
| 5,786,057 | A | 7/1998 | Lyden et al. | |
| 5,843,268 | A | 12/1998 | Lyden et al. | |
| 6,079,056 | A | 6/2000 | Fogelberg | |
| 6,098,196 | A | 8/2000 | Logan | |
| 6,408,440 | B1 | 6/2002 | Phillips | |
| 6,719,381 | B2 | 4/2004 | Cleereman et al. | |
| 6,748,601 | B2 * | 6/2004 | LaShoto et al. | 2/102 |
| 7,132,167 | B2 | 11/2006 | Stebnicki et al. | |
| D553,299 | S | 10/2007 | Le Carpentier | |
| 7,424,748 | B1 | 9/2008 | McDunn et al. | |
| D600,860 | S | 9/2009 | Durham | |
| 7,661,148 | B2 * | 2/2010 | Landi et al. | 2/24 |
| 2008/0295210 | A1 | 12/2008 | Matic et al. | |

OTHER PUBLICATIONS

30 Years of Maximum Motocross—1974-2004—FOX—Product Catalog; Copyright 2003; Fox Racing, Inc. Morgan Hill, California; cover p. 45-47, and 72 (5 pages total).

Fox MX Spring Additions 2005—Product Catalog; Copyright 2005; Fox Racing, Inc. Morgan Hill, California; cover page and 41 (2 pages total).

(Continued)

*Primary Examiner* — Tejash Patel
(74) *Attorney, Agent, or Firm* — Ganz Law, PC

(57) ABSTRACT

An item of protective gear for a body, including a section of shell material and a section of a relatively softer flexural material joined in a unitary structure, wherein the flexural material is a joint compliantly allowing for the shell material to conform to the body, or is an edge extension on the shell material for cushioning or comfort; and the item is configured to protect a specific area of a body.

10 Claims, 8 Drawing Sheets

OTHER PUBLICATIONS

FOX 2006—Product Catalog; Copyright 2005; Fox Racing, Inc. Morgan Hill, California; cover p. 41, 68, 80, and 99 (5 pages total).

FOX MX07—Product Catalog; Copyright 2006; Fox Racing, Inc. Morgan Hill, California; front and back cover pp. 116-119, 162, 173 (5 pages total).

Fox Racing R3 Chest Deflector 2006—RapidRacer—http://www.rapidracer.com/fox-racing-r3-chest-deflector-2006.html?productid=1709—Sale by Rapid Racer Copyright 2008. Website accessed Oct. 22, 2008, p. 1 of 1.

Overmolding Guide—GLS Total TPE Solutions—Copyright 2004 GLS Corporation—GLS North American Headquarters, 833 Ridgeview Drive, McHenry, Illinois 60050 USA, front and back cover plus pp. 1-31.

Related design U.S. Appl. No. 29/278,940, filed Apr. 13, 2007 by David Durham entitled Chest Protector; 18 pages.

* cited by examiner

PROTECTIVE GEAR FOR THE BODY AND METHODS OF MAKING THE SAME

RELATED APPLICATIONS

This application claims the benefit of and priority to U.S. Provisional Application Ser. No. 60/911,804, filed Apr. 13, 2007, the contents of which are hereby incorporated by reference as if recited in full herein for all purposes.

BACKGROUND

The inventive subject matter described herein generally relates to gear that protects a body from impact forces and is particularly suitable for use in motor sports, including street and off-road motorcycling (including motocross), snowmobiling, and human powered or gravity sports, such as BMX bicycling, downhill mountain biking, and skiing. It may also be suitable for other sports and activities such as football, hockey, baseball, rock climbing, whitewater kayaking, mountain climbing, and other sports or activities where there is a need to protect predetermined portions of a body from impacts.

Protective gear is commonly used in sports where a participant risks injury from accidental collisions with the ground, obstacles, or other participants. Additionally, protective gear can be worn to guard against occupational or injuries, such as hazards faced by workers in the forestry, construction, mining, and manufacturing industries. In certain respects, the inventive subject matter is directed to a protector for torso areas of the body, namely the chest, back, and shoulders. Protectors for the torso are commonly called a "chest protector" or a "roost deflector". The inventive subject matter is particularly directed to a roost deflector for use in motocross and other moto-sports or other motion sports. Accordingly, the discussion herein will use a roost deflector to illustrate the inventive subject matter.

Protective gear is a critical component for amateur and professional motorcycle enthusiasts, and manufacturers often tailor such equipment for specific uses. Off-road motorcycle riding and racing present unique challenges for protective riding gear. Not only must the equipment protect riders in the case of falls and crashes, but it must accommodate the athletic movements of a rider while maneuvering in challenging and treacherous riding terrain features, such as dirt, rock, sand, water, mud, snow, trees, stumps, boulders, brush, etc.

In the prior art, roost deflectors consist of a hard-shell material formed of, for example, polycarbonate or polyethylene, with an inner liner of a cushioning or comfort foam material. Because these materials are relatively hard so that they are able to attenuate impact forces, they also tend to be relatively inflexible and block or impede movement of a user's joints and body parts. Consequently, to accommodate such movement, a roost deflector may have multiple components of hard material joined together along flexible lines that facilitate bodily movement. The separate components are typically joined using mechanical hinges, straps, or leather or textile joints, which are typically joined to components using fasteners or adhesives. There are inherent problems in using mechanical hinges or interfacing disparate materials. For example, there may be additional manufacturing steps and associated costs, breakage of hinges or interface materials, pressure points, etc.

In view of the foregoing, there is a substantial need for improved roost deflectors and other protective gear that are: (1) strong but which allow desired movement; (2) conformable to the anatomy; (3) lightweight; (4) cooler; (5) more comfortable to use; (6) made of unitary components or sections; and/or (6) aesthetically designable.

SUMMARY

The inventive subject matter overcomes problems in the prior art and satisfies the foregoing needs. In this regard, the inventive subject matter creates a monolithic or unitary structure using hard and soft materials. As used herein, "unitary" means "having the character of a unit, not divided or discontinuous structurally." The harder materials help attenuate impact and the softer materials create zones of flexibility or elasticity such as hinges, expansion joints or other flex or elastic areas. Accordingly, a unitary structure is provided that conforms to anatomy and bodily movement. The softer materials may also be resilient materials that return to form following an applied force that deforms the material. They may also be used to create cushion zones on the harder shell material. Accordingly, a specific advantage of the inventive subject matter is that soft edges may be provided on the harder edges of the shell material, with the softer outer edges cushioning the body from contact with the harder edges.

One possible way of forming the different materials together in a unitary structure is by over-molding the softer material to the harder material. One advantage of using over-molding or a similar technique is the creation of strong and integrated sections of the protective gear. A roost deflector may be created from one or two monolithic pieces, which sharply contrasts with the prior art roost deflectors formed of many separate interconnected components of large and small sizes.

Another advantage of the inventive subject matter is that over-molding and similar techniques can provide protective gear having a low profile and without bulky fasteners. For example, over-molding with a softer material such as TPU creates low profile and seamless hinges, removing the need for large and bulky fasteners.

Another advantage is that over-molding and similar techniques can provide protective gear, such as a roost deflector, with buckle parts or attachment straps that are integrated into protector via the over-molding. For example, a TPU attachment strap is over-molded on to the hard PC shoulder shell material. Or a female or male buckle part is over-molded onto a chest shell. The over-molding creates a monolithic structure of components that is stronger than if the components were attached together as separate items, by fasteners, for example.

Another advantage is that over-molding and similar techniques can provide protective gear easier production and assembly of protective gear by creating one monolithic strong and simple part, instead of many little parts put together which require many assembly steps.

Another advantage is that over-molding and similar techniques can provide protective gear that is easier to use. For example, it may be quicker and easier to attach a male buckle to a female receptacle that is molded into a chest shell.

In addition to roost deflectors, the inventive subject matter may be directed to a variety of other forms of protective gear, such as knee guards, elbow guards, helmets, kidney belts, etc.

In certain possible embodiments that inventive subject matter is directed to a an item of protective gear for a body comprising: a section of shell material for attenuation of impact forces and a section of a relatively softer flexural material joined in a unitary structure with the shell material, wherein the flexural material is a joint compliantly allowing the shell material to conform to the body of a wearer, or is an edge extension on the shell material for cushioning or comfort; and the item is configured to cover and help protect a specific area of the wearer's body.

In another possible embodiment the, the inventive subject matter is directed to an item of protective gear for a body, comprising: a plurality of sections of a shell material for attenuation of forces and a relatively softer flexural material joined in a unitary structure with the shell material, wherein in each section the flexural material is a joint allowing for sections of the shell material to compliantly conform to the body of a wearer, or is an edge extension on the shell material for cushioning or comfort; and the item is configured to cover and help protect a specific area of the wearer's body.

In another possible embodiment, the inventive subject matter is directed to a method of making an item of protective gear, comprising: providing material for at lease one section of a shell for attenuation of impact forces and a material for at least one joint of a relatively softer flexural material; forming the shell material and flexural material into a unitary structure wherein the flexural material is a joint compliantly allowing the shell material to conform to the body of a wearer, or is an edge extension on the shell material for cushioning or comfort; and configuring the item so that it can cover and help protect a specific area of the wearer's body.

In the embodiments described herein, the shell and flexural materials may be co-molded together using an over-molding technique, for example. In the embodiments described herein, the item of protective gear may have at least one joint that is generally oriented vertically and/or at least one joint that is generally oriented horizontally. In the embodiments described herein, the item may comprise a roost deflector comprising a front portion for covering a portion of a wearer's chest and a back portion for covering a portion of a wearer's back, and each of the portions is segmented by the one or more of the joints. In the embodiments described herein, the back portion may include a horizontal joint that is interposed between upper and lower sections of shell material, compliantly allowing the shell material to conform to a wearer's back during bending. In the embodiments described herein, the back portion may include a pair of oppositely spaced joints interposed between segmented sections of shell material, each joint with at least a vertical component disposed at about the sides of a wearer's back, compliantly allowing the shell sections to compliantly conform around the sides of a wearer's body. In the embodiments described herein, the front portion may include a horizontal joint that is interposed between upper and lower sections of shell material, compliantly allowing the shell material to conform to a wearer's front side during bending. In the embodiments described herein, the item may include a front portion wherein a pair of opposite spaced joints each with at least a vertical component interposed between sections of shell material at about the sides of the wearer's body, compliantly allowing the shell material to conform around the sides of a wearer's body. In the embodiments described herein, the item may further comprise shoulder portions, for covering a wearer's shoulders, the shoulder portions comprising a shell material interconnected to a front or back portion. In the embodiments described herein, the item may include shoulder portions that are interconnected to the front or back portions as unitary structures. In the embodiments described herein, the item may further comprise an attachment element, such as a strap or buckle component joined to a section of the shell material or flexural material of the item in a unitary structure.

These and other embodiments are described in more detail in the following detailed descriptions and the figures.

The foregoing is not intended to be an exhaustive list of embodiments and features of the present inventive subject matter. Persons skilled in the art are capable of appreciating other embodiments and features from the following detailed description in conjunction with the drawings.

BRIEF DESCRIPTION OF THE DRAWINGS

The following figures show a representative item of protective gear, namely a roost deflector, and components thereof, according to the inventive subject matter, unless noted as showing prior art.

DETAILED DESCRIPTION

Figure 1:
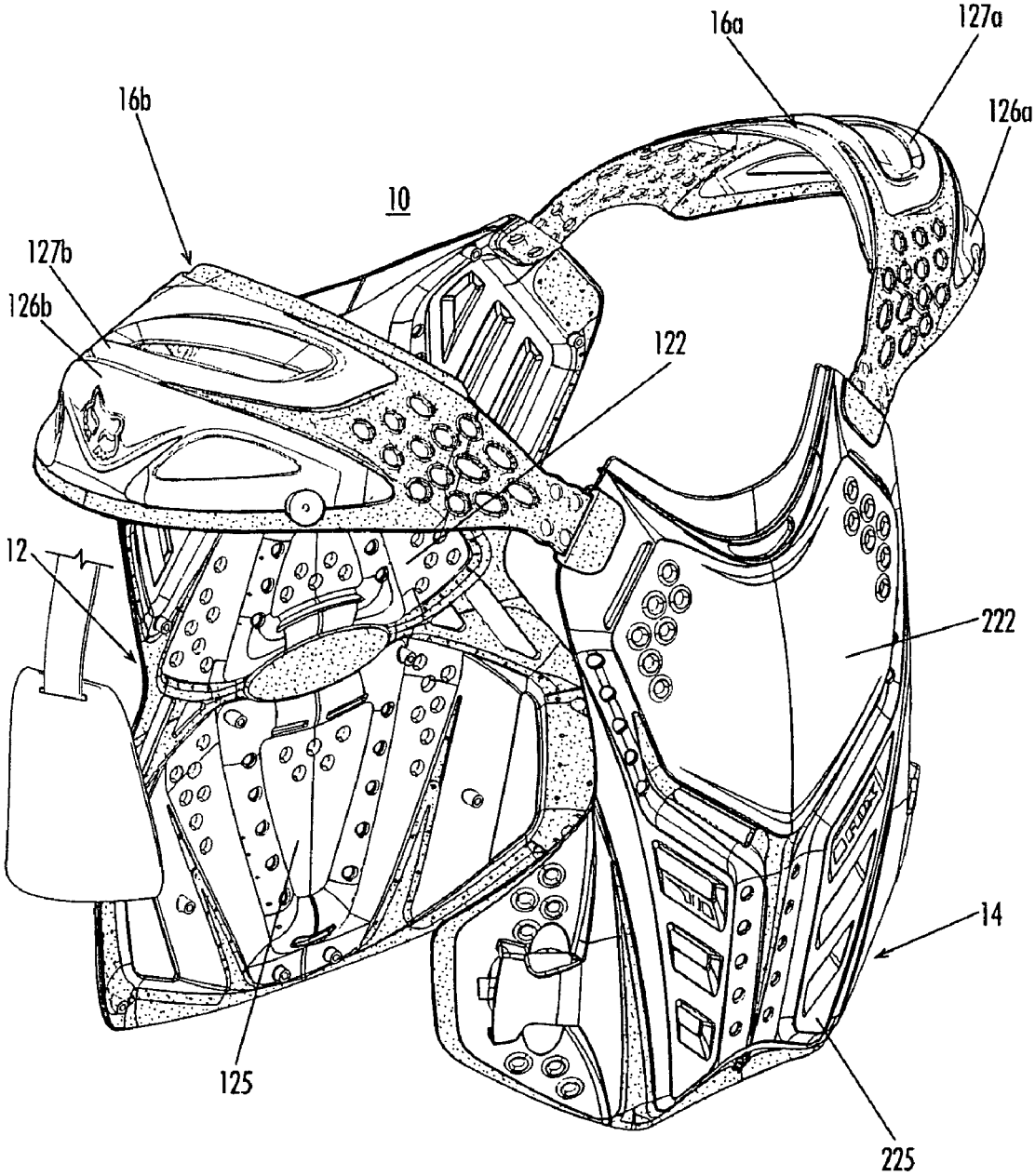
FIG. 1 is a front perspective view.
Figure 2:
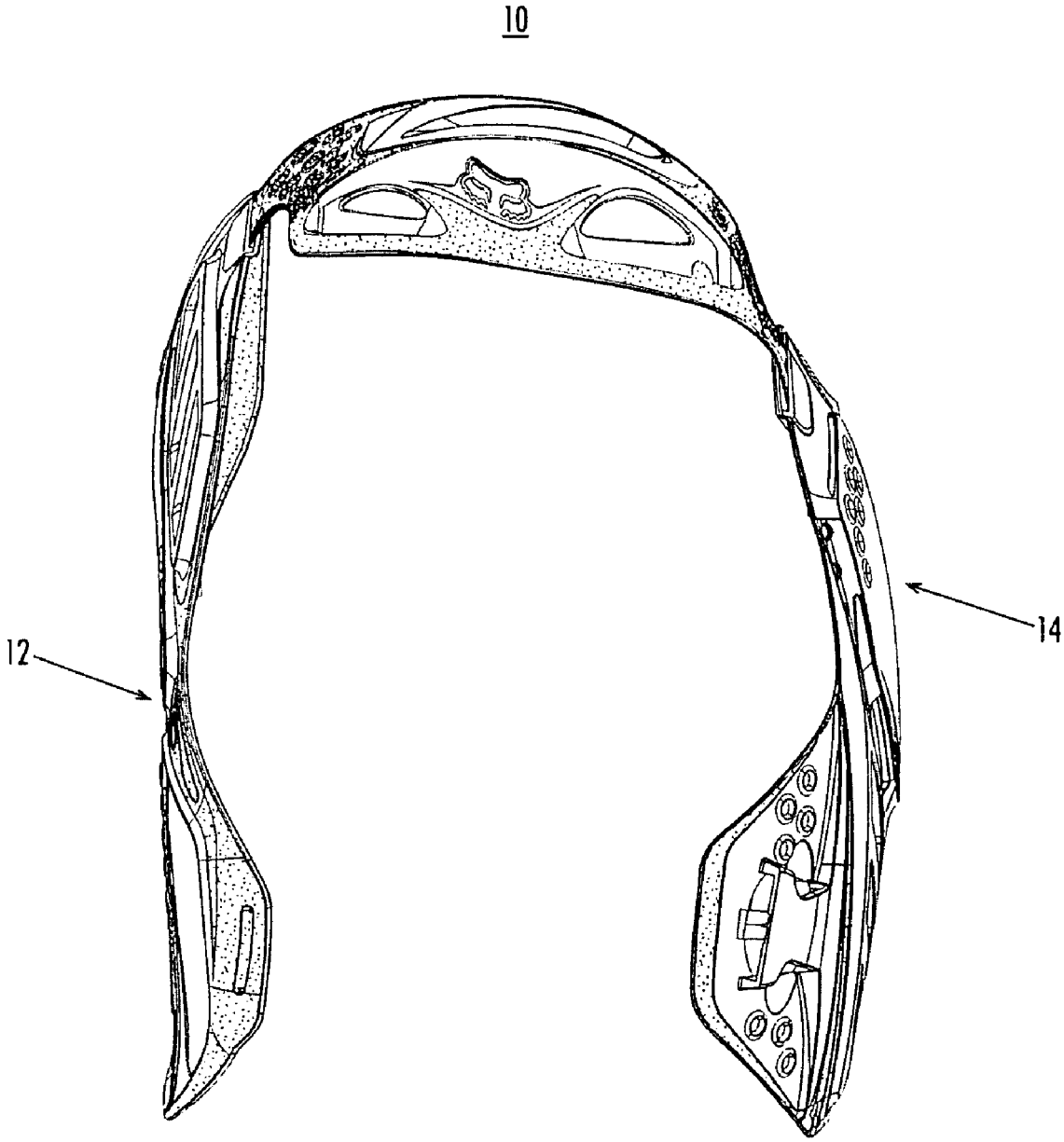
FIG. 2 is a right side view.
Figure 3:
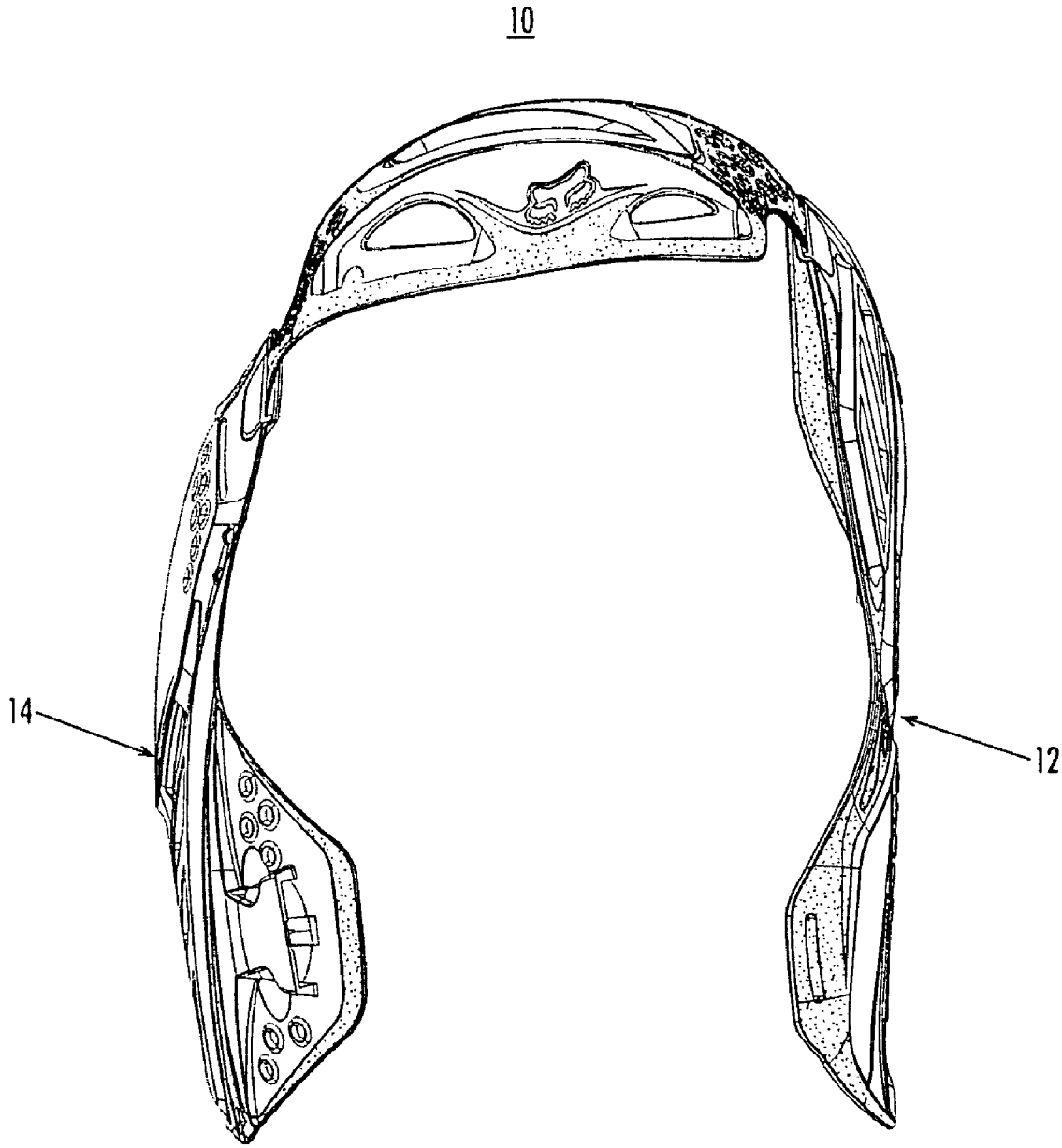
FIG. 3 is a left side view.
Figure 4:
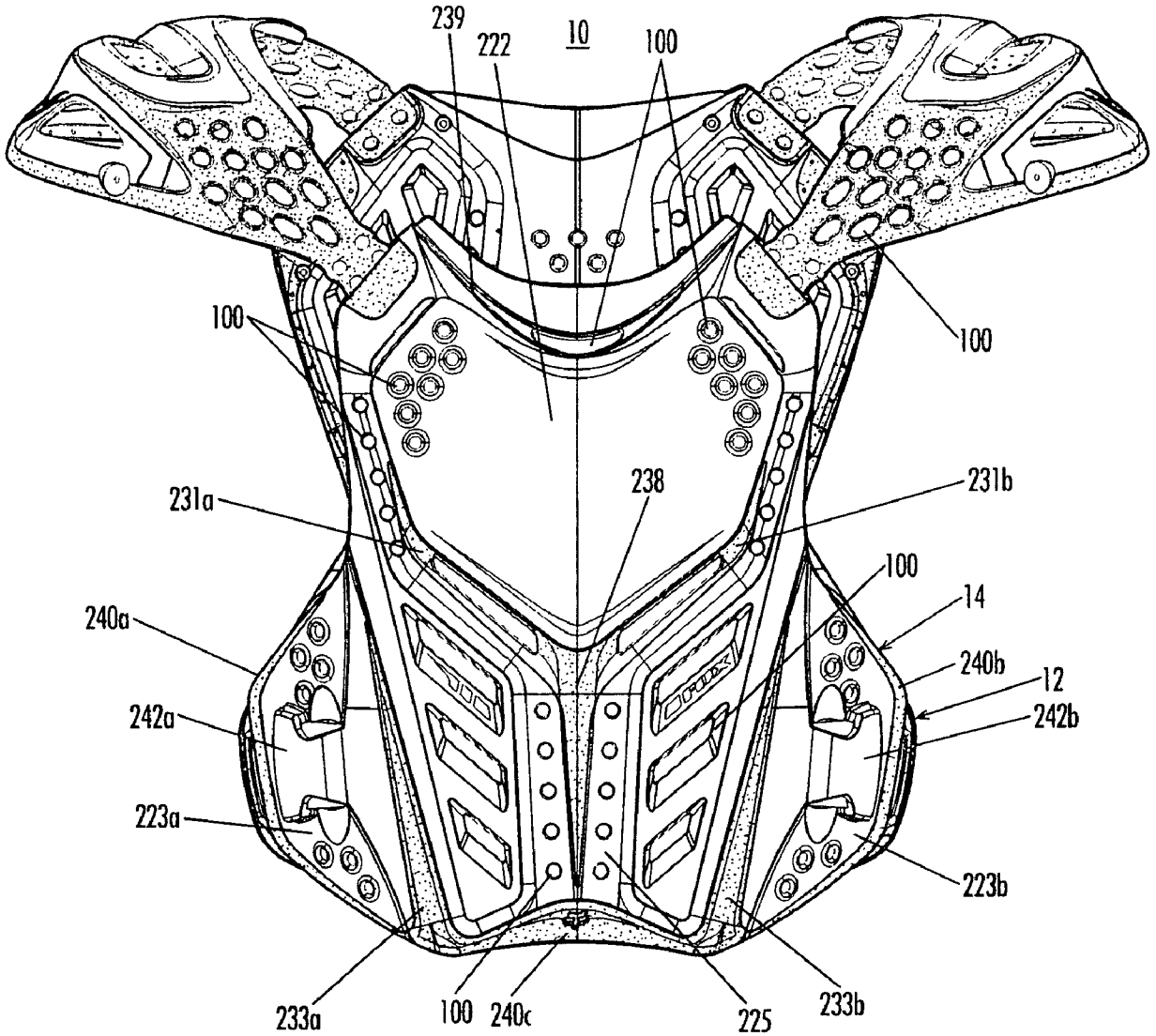
FIG. 4 is a front view.
Figure 5:
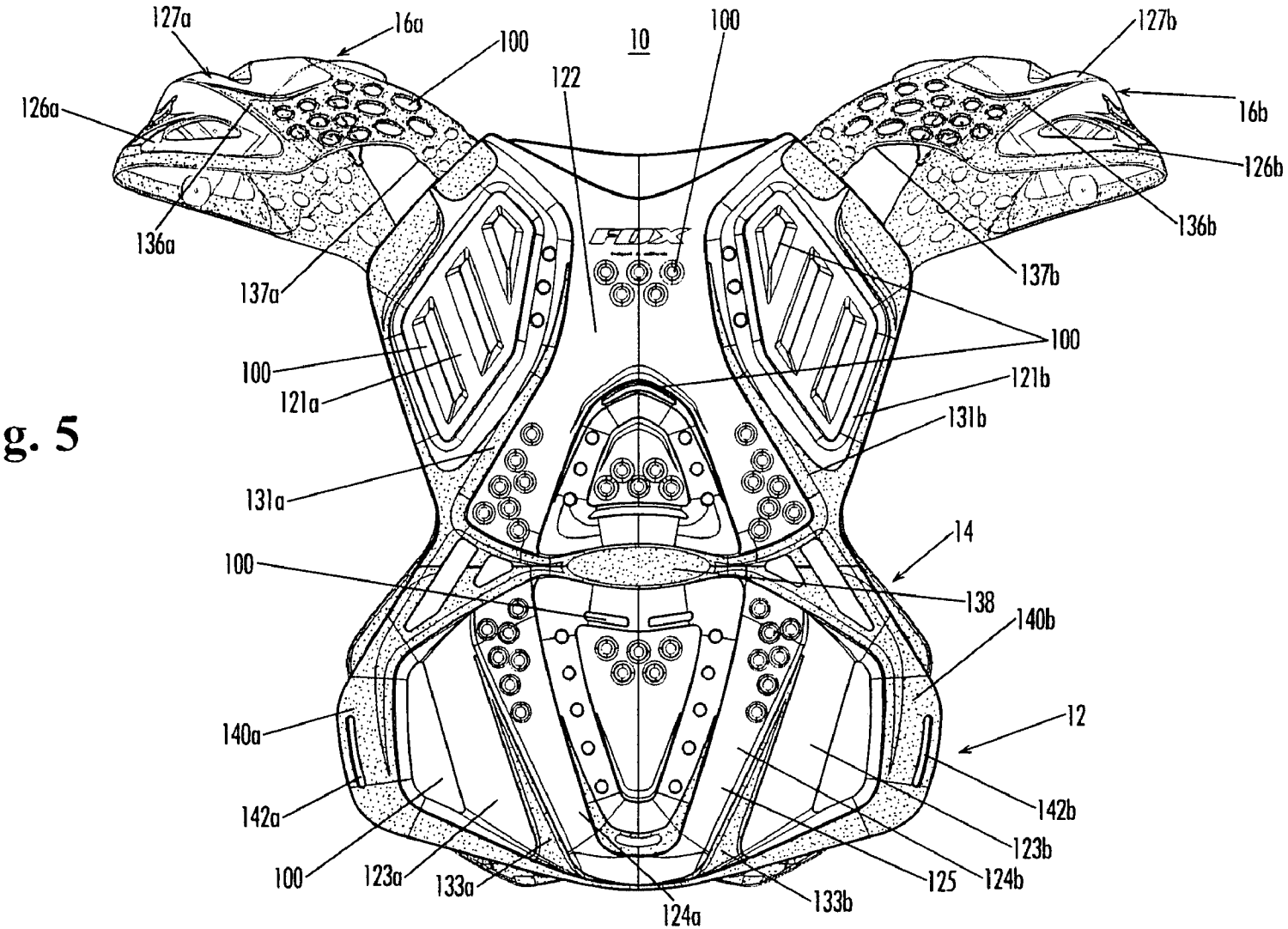
FIG. 5 is a rear view.
Figure 6:
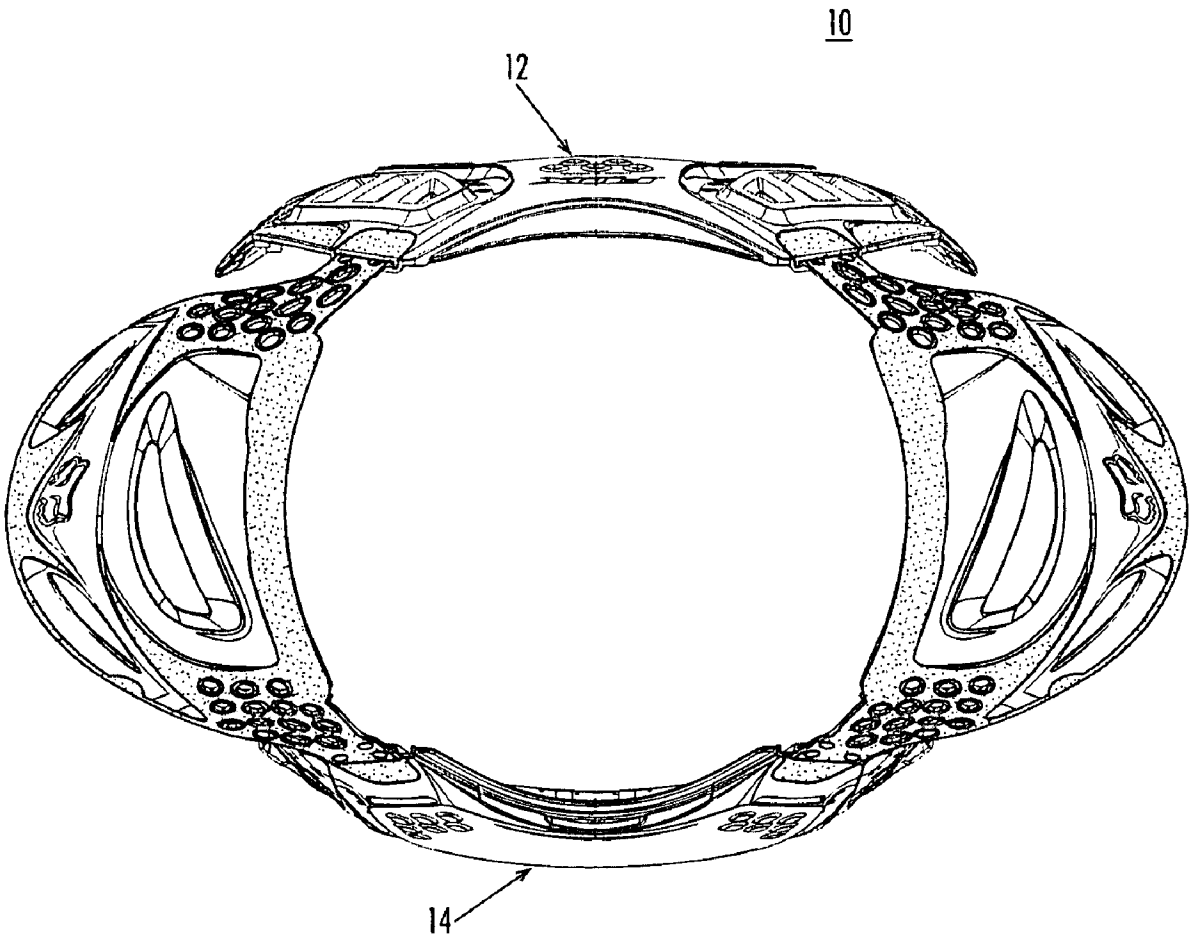
FIG. 6 is a top view.
Figure 7:
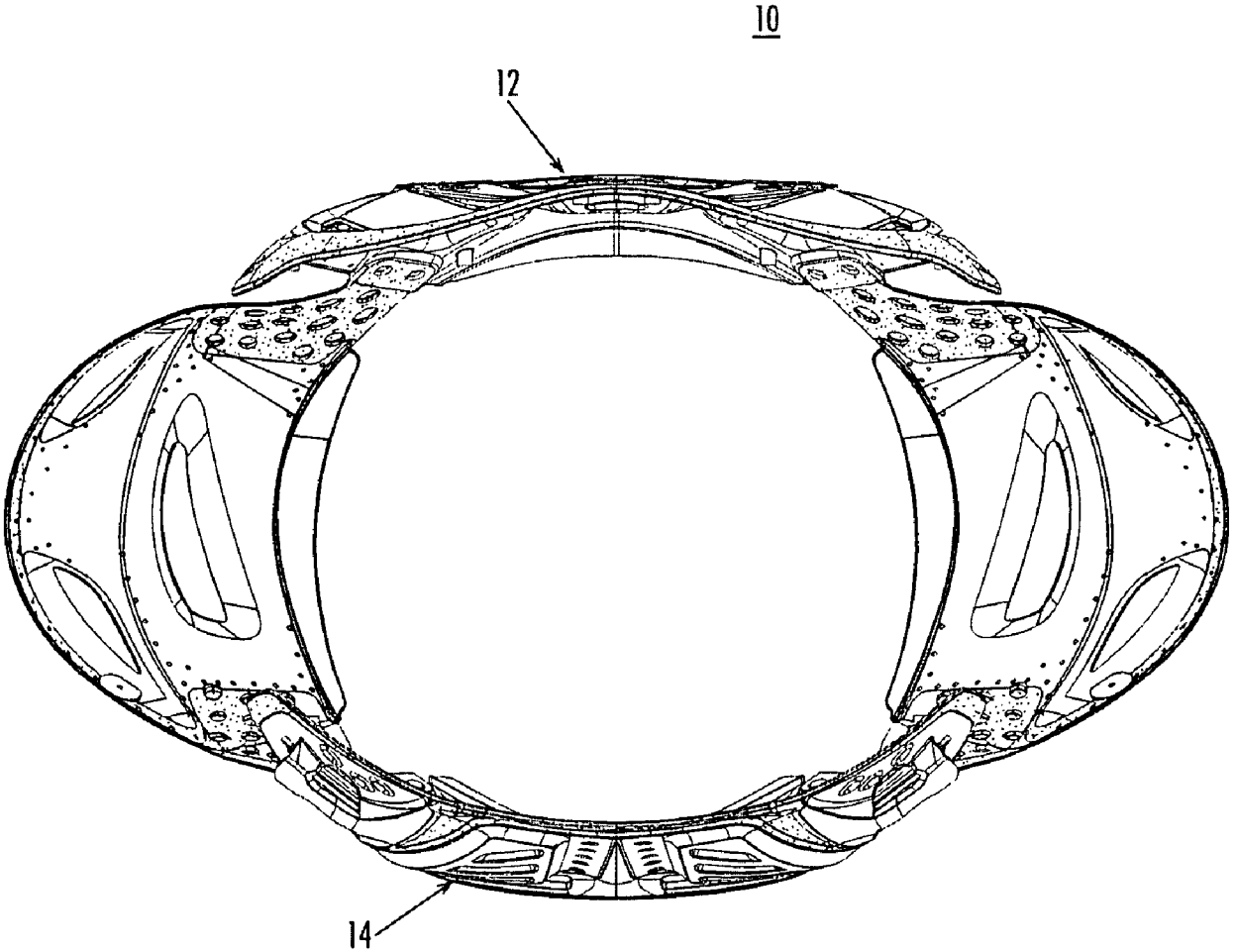
FIG. 7 is a bottom view.

Representative embodiments according to the inventive subject matter are shown in FIGS. 1-9, wherein similar features share common reference numerals. The inventive subject matter is generally directed to the use of a flexural material that spans two sections of a shell material that is rigid for attenuation of impact forces. The flexural material allows for relative movement of section of shell material joined to the flexural material. However, the joint can be just the junction of shell material and flexural material, without the flexural material spanning between sections of shell materials. The sections of shell materials may be of a two-dimensional or three-dimensional conformation. Three dimensional conformations are typically intended to correspond to predetermined curvatures of the wearer's body.

To illustrate the inventive subject matter relating to improved protective gear and methods of manufacture, the following discussion and referenced Figures use a roost deflector as a representative example implementing the inventive subject matter.

A roost deflector 10 typically comprises a back portion 12 for covering some portion of the back of a wearer, a front portion 14 for covering some portion of the front chest or other frontal area of the wearer, and shoulder portions 16*a-b* for covering some portion of the shoulders. The portions 12, 14, and 16 are interconnected so as to form a single unit of protective equipment. (In the single unit, components may be removably engaged to each other.) The roost deflector's sections include sections of shell materials, for example, 121-126 that are relatively hard for attenuating impact forces, and are not necessarily comfortable against body parts because of their inability to conform with the movement of the body or because of hard edges. Accordingly, a roost deflector also typically includes relative soft cushiony materials associated with body facing surfaces of the shells and edges of the shells. Such materials may be referred to as "biofoam". They may include a liner layer, such as Lycra™. These softer materials may also serve to attenuate forces and/or to provide a comfort layer between the relatively hard shell materials and the wearer's body.

The roost deflector may also include straps or other interconnects for joining components around the body of a wearer.

The roost deflector may also include a portion for covering anatomy above the shoulders, such as the neck, or anatomy below the waist line, such as the groin, tail bone, or buttocks.

In certain respects the inventive subject matter is directed to a roost deflector wherein the shell sections comprise two or more molded materials that are molded together along a junction line that allows for movement. As used herein, unless otherwise indicated, "section" generally means any designated area of an item of protective gear, for example, it can be an area spanning components of a roost deflector, an individual component, or a subsection within another designated section or component.

The contemplated shell materials generally are polymers or polymer-based composite materials, such as carbon fiber or fiberglass, using polymer resins. Particularly suitable polymer materials may be plastics and elastomers, particularly thermoplastics and thermoplastic elastomers, as well as alloys of such materials.

A first material used in the inventive protective gear comprises a relatively hard and inflexible material intended as a shell for attenuating impacts in an intended application, such as motocross. Such materials are often characterized as having a higher Shore A durometer or higher flexural modulus. Typical materials have a Shore A Durometer of from about 60 to about 90. Some suitable plastic or other polymer shell materials are, for example, polycarbonate resin thermoplastic, such as LEXAN® polycarbonate; polypropylene; acrylonitrile butadiene styrene (ABS); PC/ABS Alloys; Styrene, Nylon, HIPS+Nylon 6 and 6,6; polyethylene; copolyester; propionate; and acetal. In addition to polymer-based materials, the shell could also include or be based on, in whole or part, metals. Exemplary metals include aluminum, stainless steel, and titanium. Alloys of metals may also be used. The metals may be provided, for example, as stamped, molded, or thin-walled forms.

A second material used in combination with the first material is a relatively soft material having a low modulus, such as a thermoplastic elastomer (TPE), that allows for flexibility and relative movement of the section of the first material, to which it is molded, welded, bonded, or otherwise connected. Such materials are often characterized as having, relative to the first material, a lower Shore A Durometer or lower flexural modulus. Typically, such materials have a Shore A Durometer of from about 30 to about 80. Typically, the first, shell material will have a Shore A durometer that is at least about 10 to about 40 Shore A-Durometer points higher than that of the second, flexural material. One suitable flexural material for use with a shell material, for example, LEXAN® polycarbonate, is a TPU (thermoplastic polyurethane elastomer) or a TPU alloy. These TPE materials are available from GLS Corporation, McHenry, II, USA, and other commercial sources. GLS Corporation sells a variety of TPE materials under the VERSOLLAN and VERSAFLEX families for bonding to plastics such as PC; ABS; PC/ABS; and copolyester.

It is noted that the shell and flexural materials are classes of materials, one being relatively harder and more suited for the primary force attenuation function of a protector, and the other being more suitable for providing a joint or zone of flexibility or softness. Accordingly, the shell material may be of a homogeneous or heterogeneous nature. For example, the shell may be composed of adjacent sections of different materials, or it may be composed of lamination of different materials or composite materials, with the overall structure being a shell material. The flexural sections may be similarly composed of heterogeneous flexural materials. Further, any section of material may be a composite material, such as a carbon fiber or fiberglass material. Accordingly, the term "material", unless context indicates otherwise, is used in a broad sense, not limited to homogeneous materials.

The specific materials mentioned above are good examples of low modulus materials and rigid materials that provide a good balance of the desired material properties for a roost deflector. The materials are representative of a much larger array of options with respect to materials. Other thermoplastics choices and combinations of rigid and low modulus materials are also capable of providing similar structure. They should be selected to provide the desired combinations of processability, modulus, strength, rigidity, and compatibility. Preferably, in one possibly process according to the inventive subject matter, the shell and flexural materials can be overmolded or injection molded in the same injection molding machine, such as in a two shot molding process or an overmolding process. Non-thermoplastics, such as composites, or even metals, could also be used as a shell material in connection with overmolding or other known processes for molding or bonding to dissimilar materials.

The inventive subject matter is directed at providing a unitary joining of the shell and flexural materials to form a unitary construction of sections of the protector but with selective material properties. One suitable method is an overmolding or co-molding process that seamlessly joins the flexural material to the shell material.

Other techniques that may be used to produce or process the shell materials and flexural materials include: co-extrusion, compression molding; liquid molding, such as resin transfer molding (RTM); ultrasonic welding, and heat welding.

Overmolding techniques suitable for use in the inventive subject matter are well known in the art and may be readily adapted by persons skilled in the art for use in light of the teachings herein. For example, the GLS Corporation provides information on over-molding on its website www.glscorp.com. In general, in a representative process using PC and TPU as the shell and flexural materials, hard PC shells are first injection molded. Flashing and gate runners are removed. Plastic is cleaned of mold release, oils, or other contaminants. The PC shells are placed into over-mold tool. TPU is injected over PC shells, creating both a chemical and/or physical/mechanical bond. Mechanical bonding may be achieved, for example, by providing holes or other structures in the PC shells for the TPU to fill or encapsulate. Heated TPU flows through or around holes or other structures and hardens, creating integrated fasteners.

The co-molding of rigid polymers to relatively softer polymers is also taught in U.S. Pat. Nos. 5,786,057, 5,843,268, 6,719,381, and 7,132,167, which are hereby incorporated by reference in their entireties, particularly with respect to materials combinations disclosed and molding techniques disclosed.

FIGS. 1-9 represent one possible novel arrangement of sections of shell and flexural materials in a roost deflector 10. In the figures, the stippled surface areas represent the flexural material and the white surface areas, the shell material. The roost deflector has a back portion 12 that includes an upper back shell section 122 that generally sits at about the neckline and extends downwardly to about the bottom of the wearer's rib cage. It is interconnected by a flexural material section 138 to a lower shell section 125 that downwardly extends to about the wearer's waist line. The areas of coverage may vary according to the application. Shell sections 122 and 125 include left and right shell sections 121*a-b*, 123*a-b* and 124*a-b* with a plurality of joints of flexural material. For example, joints 131*a* and 131*b* of flexural material span, respectively, shell sections 121*a* and 122, and shell sections 122 and 121*b*. These joints allow the back section to flex with the anatomy and to wrap around the sides of the wearer.

The back portion 12 and other sections may include various apertures, representative ones of which are denoted with the reference number 100. The apertures in the shell and/or flexural materials may be used to facilitate ventilative cooling, provide aesthetics, define flexural lines, provide openings for male and/or female fasteners, such as snaps, and/or to lighten the weight of the protector. Some apertures or molded features may also be used for receiving or routing straps, closures or connectors. For example, front portion 14 includes female receptacles 242*a-b* for a buckle insert and strap system. The back portion 12 includes corresponding slots 142*a-b* for receiving the strap of such a system. The apertures may be formed during molding, milling, drilling, turning, or other processes.

Front portion 14, is configured in a corresponding manner to provide flexible sections that allow section of the deflector to conform to the body and its movements. There is an upper central section of shell material 222 disposed above a lower set of left and right shell sections 223*a-b*, and a lower central section 225. Section 222 has flexural material sections 231*a*, 231*b*, and 239 that are over-molded on the shell material of section 222 and aesthetically define the central section into two subsections. Alternatively, the flexural material sections could be joints that separate sections of the shell material.

Joints 233*a-b* span, respectively, sections 223*a* and 225 and sections 225 and 223*b*. Section 225 has flexural material section 238 that is over-molded on the shell material of section 225 and aesthetically defines the section 225 into two subsections. Alternatively, the flexural material could be a joint that separates sections of shell material.

As can be seen the various shell material sections are not completely separate, but are connected by at least bridges of material. For example, section 223*a* is separated from lower central section 225 by an upwardly tapering joint 233*a* that merges into a bridge or shell material connecting section 233*a* directly to section 225. Other joints are similarly constructed and enable the entire front portion 14, back portion 12, and/or shoulder portions to be a single molded part. Alternatively, sections of shell material could be entirely separate pieces that are interconnected by only the flexural materials.

Figure 8:
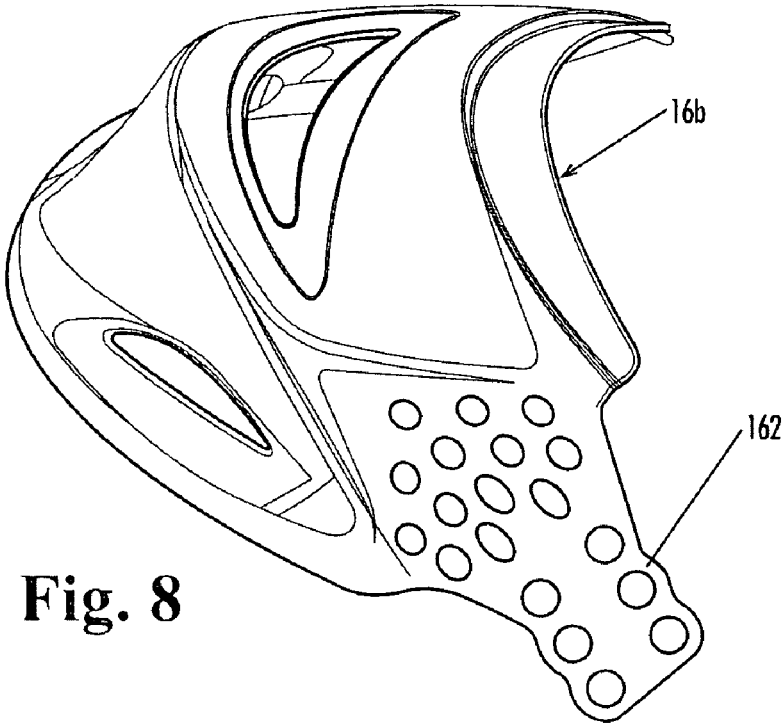
FIG. 8 shows in perspective details of a shoulder protector with a rear connector for engaging a rear section of protective gear.
Figure 9:
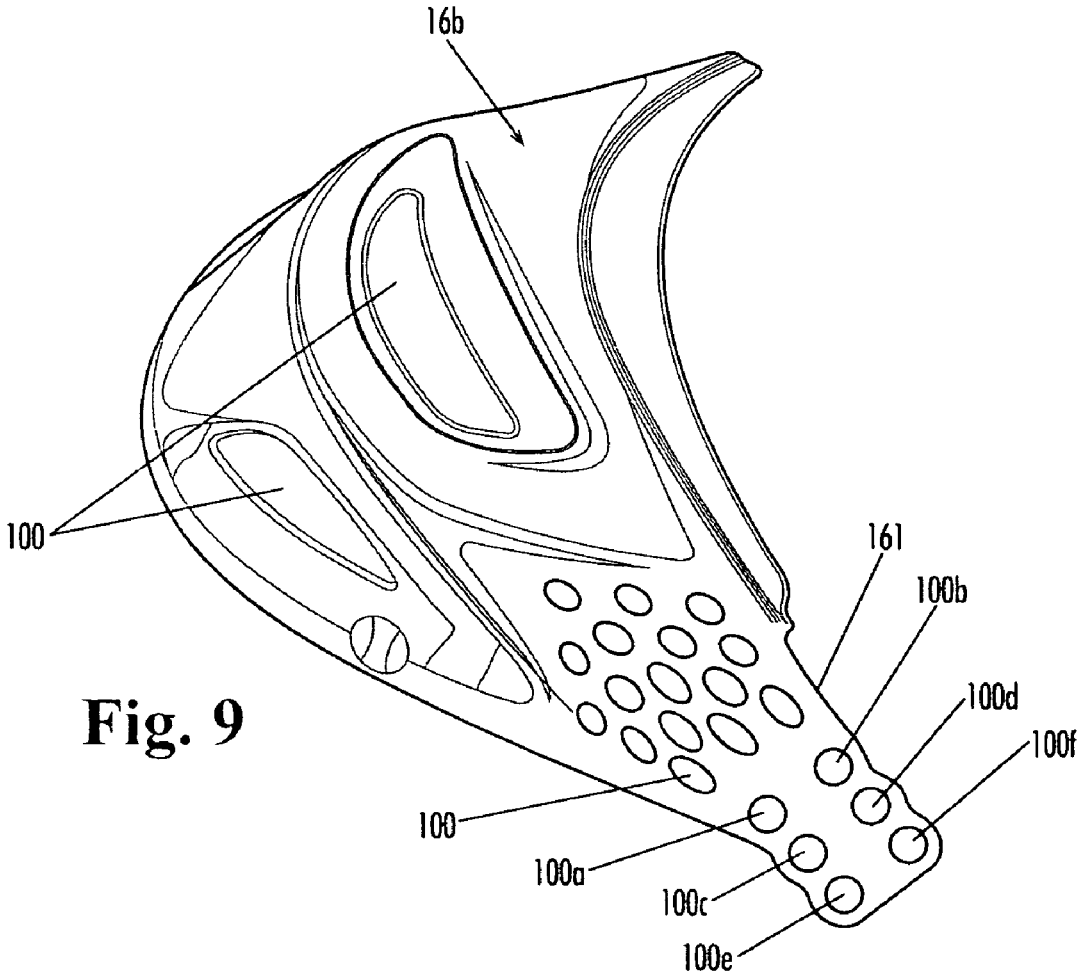
FIG. 9 shows in perspective details of a shoulder protector with a front connector for engaging a front section of protective gear.

The roost deflector also includes shoulder portions 16*a-b*. As indicated, they may be molded in a unitary manner with the front portion 14 and/or the back portion 12. The shoulder protector may also be segmented into shell subsections using flexural materials. For example, joints 136*a-b* of flexural material may separate shell sections 127*a-b* and 126*a-b*. Alternatively, in the embodiment shown, the shoulder protectors are adjustably connected to the front 14 and/or back 12 portions using straps or other connectors. The components may be adjusted by a wearer to achieve enclosure of the roost deflector over a wearer's body and an appropriate fit. FIGS. 8-9 show details of rear and front connectors for a shoulder portion 16*a* or 16*b*. The connectors 161 (front) and 162 (rear) extend downwardly from the shoulder portion 16*b*. The connectors may be formed from any material of sufficient strength and flexibility. For example it may be formed of a flexural material or a textile. Advantageously, the connectors may be formed with or incorporated into the shell or flexural material of the shoulder protector and/or the back 12 or front 14 portions, as described above, by, for example, over-molding.

Each connector has a set of holes (lower set of three pairs 100*a-b, c-d*, and *e-f*) for engaging another section of the roost deflector. The wearer selects one pair from the set. The selected pair is engagably aligns with and mates with complementary studs or other fastener on the back portion 12 and/or front portion 14. Alternatively, the back section may have complementary holes that align with a pair of holes on the shoulder protector. In this case an interlocking fastener, such as a nut and bolt combination may be placed in the aligned holes to connect the components together.

The roost deflector may also include additional protectors, such as the arm protectors connected to shoulder portions 16*a-b*, as seen in FIG. 1.

The various sections of the roost deflector may also include flexural material on edges of shell material to provide a more compliant, cushioned, or comfortable fit against body parts. For example, flexural material sections 140*a-b* are disposed along the edges of shell sections 123*a-b* of back portion 12; flexural material sections 240*a-c* are disposed on shell sections 223*a-b* and 225 of front portion 14. The flexural material may also be disposed underneath the shell materials, between the shells and the wearer's body.

As can be seen the joints have varying orientations that segment each of the front 14 and back 12 portions of the roost deflector. Some joints, e.g., 233*a-b*, are vertically oriented to allow hinging of sub-sections around sides of the body. There are also joints more horizontally oriented, e.g., 138, that allow the shell subsections to move with the body, for example, in reaction to the expansion of the chest on taking a breath or leaning over. There also joints that have vertical and horizontal components, e.g., 231*a-b*. The joints allow hinging of a section in and out of plane. Accordingly, it can appreciated that the inventive subject matter, among other things, provides anatomically segmented sections that compliantly fit and adapt to body movements along a plurality of anatomical axes. By selecting flexural materials with appropriate elasticity the sections are made to be resiliently compliant.

Persons skilled in the art will recognize that many modifications and variations are possible in the details, materials, and arrangements of the parts and actions which have been described and illustrated in order to explain the nature of this inventive subject matter and that such modifications and variations do not depart from the spirit and scope of the teachings and claims contained therein.

All patent and non-patent literature cited herein is hereby incorporated by references in its entirety for all purposes.

The invention claimed is:

1. An item of protective gear for a body, comprising:

a section of shell material for attenuation of impact forces and a section of a relatively softer, molded thermoplastic flexural material joined in a unitary structure with the shell material, wherein the molded thermoplastic flexural material is a joint compliantly allowing the shell material to conform to the body of a wearer; and the item is configured to cover and help protect a specific area of the wearer's body;

wherein the item comprises a roost deflector having sections of the shell and the molded thermoplastic flexural materials.

2. An item of protective gear for a body, comprising:

a plurality of sections of a shell material for attenuation of forces and a relatively softer, molded thermoplastic flexural material disposed between the sections and joined in a unitary structure with the shell material, wherein in each section the molded thermoplastic flexural material is a joint allowing for sections of the shell material to compliantly conform to the body of a wearer, or is an edge extension on the shell material for cushioning or comfort;

the item is configured to cover and help protect a specific area of the wearer's body; and wherein the item comprises a roost deflector comprising a front portion for covering a portion of a wearer's chest and a back portion for covering a portion of a wearer's back, and each of the portions is segmented by one or more of the joints.

3. The item of claim 2 wherein the back portion includes a horizontal joint that is interposed between upper and lower sections of shell material, compliantly allowing the shell material to conform to a wearer's back during bending.

4. The item of claim 3 wherein the back portion includes a pair of oppositely spaced joints interposed between segmented sections of shell material, each joint with at least a vertical component disposed at about the sides of a wearer's back, compliantly allowing the shell sections to compliantly conform around the sides of a wearer's body.

5. The item of claim 2 wherein the front portion includes a horizontal joint that is interposed between upper and lower sections of shell material, compliantly allowing the shell material to conform to a wearer's front side during bending.

6. The item of claim 5 wherein the front portion includes a pair of opposite spaced joints each with at least a vertical component interposed between sections of shell material at about the sides of the wearer's body, compliantly allowing the shell material to conform around the sides of a wearer's body.

7. The item of claim 2 further comprising shoulder portions, for covering a wearer's shoulders, comprising a shell material interconnected to a front or back portion.

8. The item of claim 7 wherein the shoulder portions are interconnected to the front or back portions as unitary structures.

9. The item of claim 8 wherein the shoulder portions are interconnected via connectors that are unitary with the shoulder sections and/or the front and/or back portions.

10. A method of making an item of protective gear, comprising:

providing a material for at least one section of a shell for attenuation of impact forces and a material for at least one joint of a relatively softer, molded thermoplastic flexural material;

forming the shell material and the molded thermoplastic flexural material into a unitary structure wherein the molded thermoplastic flexural material is a joint compliantly allowing the shell material to conform to the body of a wearer, or is an edge extension on the shell material for cushioning or comfort;

configuring the item so that it can cover and help protect a specific area of the wearer's body;

wherein a molded thermoplastic material is provided for a plurality of sections of the shell and a plurality of sections of the joints all in a unitary structure; and wherein the item comprises a roost deflector comprising a front portion for covering a portion of a wearer's chest and a back portion for covering a portion of a wearer's back, and each of the portions is segmented by the one or more of the joints.

* * * * *